US005339477A

United States Patent [19]

Warner et al.

[11] Patent Number: 5,339,477

[45] Date of Patent: * Aug. 23, 1994

[54] APPARATUS FOR REMOVING COATINGS FROM FINGERNAILS

[75] Inventors: Ronald C. Warner, Waleska; Craig M. Warner, Alpharetta, both of Ga.

[73] Assignee: Ron Warner Associates, Norcross, Ga.

[ * ] Notice: The portion of the term of this patent subsequent to Feb. 16, 2010 has been disclaimed.

[21] Appl. No.: 17,247

[22] Filed: Feb. 12, 1993

Related U.S. Application Data

[62] Division of Ser. No. 638,334, Jan. 7, 1991, Pat. No. 5,185,900.

[51] Int. Cl.[5] ..... A45D 29/17

[52] U.S. Cl. ..... 15/97.1; 15/104.92; 132/73.6

[58] Field of Search ..... 15/21.1, 21.2, 97.1, 15/104.92; 132/73.6, 75, 75.8

[56] References Cited

U.S. PATENT DOCUMENTS

| | | | |
|---|---|---|---|
| 2,424,509 | 7/1947 | Singer | 15/97.1 |
| 2,713,693 | 7/1955 | Johnson | 15/97.1 |
| 4,255,826 | 3/1981 | Boyd | 15/21.1 |
| 4,381,574 | 4/1983 | Benkovsky | 15/97.1 |
| 4,478,232 | 10/1984 | Yasuda | 15/97.1 |
| 4,699,161 | 10/1987 | Smith et al. | 15/244.1 |
| 4,800,606 | 1/1989 | Kolesky | 15/97.1 |
| 5,007,441 | 4/1991 | Goldstein | 15/97.1 |
| 5,054,503 | 10/1991 | Keller | 132/73.6 |

*Primary Examiner*—Edward L. Roberts
*Attorney, Agent, or Firm*—Kenneth E. Darnell

[57] ABSTRACT

A motorized device for removing nail coatings such as fingernail polish or the like and usable by either a professional manicurist or by an individual caring for her own nails, the invention includes a container controllably rotatable in both clockwise and counter-clockwise directions, the container receiving a single-use cartridge filled with a flexible foam body saturated with a solvent capable of removing the coating. In the environment of a beauty salon, a client inserts each nail sequentially into a finger-receiving slit in the foam body of the cartridge and the cartridge-bearing container is rotated after each insertion to remove the coating, the cartridge then being discarded so that only one client uses a given cartridge. Sequential reversing of the cartridge-bearing container according to the invention speeds removal of the nail coating especially in cuticle areas from which nail coatings are difficult to remove according to prior methodology.

9 Claims, 2 Drawing Sheets

APPARATUS FOR REMOVING COATINGS FROM FINGERNAILS

This is a division of copending application Ser. No. 07/638,334, filed Jan. 7, 1991 now U.S. Pat. No. 5,185,900.

BACKGROUND OF THE INVENTION

1. Field of the Invention

The invention relates generally to both method and apparatus for removing nail coatings and particularly fingernail polish from the nails of a user.

2. Description of the Prior Art

The most common nail coating takes the form of a variety of fingernail polishes which include a solvent such as acetone, the polish hardening on evaporation of the solvent after application to the nails. Such coatings are usually removed in order to apply new coating or to simply remove the coating for convenience. Removal of nail coatings such as fingernail polish has traditionally been accomplished by application of a nail polish remover which includes acetone or the like to a cotton ball and by then rubbing the acetone-bearing cotton ball against the polished nail. This time-consuming and messy process has conventionally been employed both by the professional manicurist and by the "home" user. In recent years, the home user has had available to her "dip" nail polish removal devices which include a nail polish removal solvent saturated in a foam body whereby the user dips each nail sequentially into a slit formed in the foam body so that polish is readily removed from each nail. The professional manicurist cannot use the dip nail polish removal devices of the prior art unless one of such devices is provided for each client. Health regulations do not allow use of such devices by more than one client due to sanitation reasons. Since the residue of nail polish from a previous user of such devices remains in the devices, the fingers of a subsequent user can become discolored from the residue remaining in the device. Still further, the polish residue in such devices accumulates and causes the solvent within the devices to weaken and thus require a longer period of time for removal of polish. Motorized nail polish removal devices also exist as exemplified by Boyd in U.S. Pat. No. 4,255,826 which discloses a cup containing a mohair brush or the like wherein the cup is rotatable in one direction only and receives each finger sequentially for removal of polish from each nail. In order for the Boyd device to be used by professional manicurists, it would be necessary for the manicurist to remove contaminated polish remover from the Boyd device after use by each client and to clean the mohair brush, a process which would require at least partial disassembly of the device to remove the brush and contaminated polish remover. Use of a brush in a motorized device for polish removal also tends to cause wear on the finger of a user and further does not remove polish quickly from a nail and especially from difficult areas such as the cuticle.

Again referring to the environment of the beauty salon, the professional manicurist is further disadvantaged by prior methodology for nail polish removal since the manicurist has not been able to wear nail polish due to the fact that the manual process of removing the client's polish with a saturated cotton tissue would at least partially remove or disfigure any polish or coating on the manicurist's own nails. The manicurist is further disadvantaged by the continual contact of acetone and other polish removal solvents with the fingers and hands, these solvents defating the hands and fingers quickly and thus causing the hands to dry out. The manual method of removing nail polish is also time consuming and requires that the manicurist be personally involved with the client during the nail polish removal work phase. The professional manicurist would definitely welcome a less labor-intensive method for removal of nail polish and especially would welcome the ability to be removed from the location of the polish removal in order to be accomplishing other tasks and also to be subjected less to fumes of the polish removal solvent, the inhalation of which may be injurious to health.

A long-felt need thus exists, especially by the professional manicurist, for methodology and apparatus which provide more rapid and safer removal of nail coatings such as nail polish and which decreases the involvement of the manicurist with a client during a relatively perfunctory work phase such as the removal of nail polish while increasing the ability of the manicurist to create greater dollar volume when freed of a task requiring little skill. The methodology and apparatus of the present invention not only provides these advantages to the professional manicurist but further enables the manicurist to substantially avoid contact with solvents which dry the hands and fingers and also to reduce inhalation of solvent fumes associated with removal of nail coatings and especially fingernail polish from the nails of clients. Practice of the invention by the professional manicurist also allows the manicurist to wear nail polish or to use other nail coatings without damage thereto, this ability causing the manicurist to personally display glamorous nail coatings, polish patterns, etc. which can constitute an immediate advertisement of the valuable services of the manicurist.

SUMMARY OF THE INVENTION

The invention provides method and apparatus for removing coatings such as fingernail polish from the fingernails, the invention being particularly useful to a professional manicurist who must operate under certain legal and ethical constraints relating to sanitation and who is particularly impacted disadvantageously by prior methodology for removal of nail coatings from the nails of clients. The invention can also be utilized by the "home" user since a substantial number of advantages accrue to the home use and to any user, these advantages relating to ease of use, effectiveness in removing nail coatings both rapidly and efficiently in difficult portions of the nail such as the cuticle area, reduced exposure to solvents both to the hands and fingers by the liquid phase of the solvents and exposure to solvent fumes. The apparatus of the invention includes a motor-driven container open at the top end of the container for receipt of a single-use cartridge filled with a flexible foam body saturated with a solvent capable of removing a nail coating such as fingernail polish. The foam body contained within the cartridge is provided with a finger-receiving slit, slot, aperture or series of slits, such that each finger can be inserted into the solvent-saturated foam body and the container, and thus the cartridge and foam body, rotated to rapidly remove the nail coating from the nails of a user. The abrasion provided by surfaces of the foam body which contact the nail coating coupled with the solvent being contacted with the nail coating through saturation by the solvent of the foam body quickly causes removal of the nail coating from the fingernail. Rotation of the container can be intermittently changed from clockwise to counter-clockwise rotation in order to facilitate removal of the nail coating especially from the cuticle areas and the like. The direction of rotation can be changed within a single revolution or can be changed after a desired number of revolutions.

The present apparatus is sufficiently simple and easy to use that the professional manicurist can allow a client to utilize the apparatus while the manicurist is involved with tasks requiring greater skill than that of simply removing nail coatings such as fingernail polish from the nails of the client. The invention thus saves substantial professional time and further reduces exposure of the manicurist to solvents. The apparatus further reduces exposure to solvent fumes on the part of both the professional manicurist and the client (as well as any user) due to the fact that the solvent-containing cartridge is sealed prior to use and is only opened through the sealing structure by means of an aperture which is essentially only large enough for insertion of the finger therethrough. Accordingly, the solvent and fumes of the solvent are less able to either contact more anterior portions of the fingers and hands or be inhaled or contact the eyes and other sensitive portions of the body. Ambient exposure of individuals in a beauty salon to solvent fumes is therefore reduced substantially through use of the present invention.

The foam material comprising the flexible foam body contained within the single-use cartridge of the invention can be made such that the foam or portions of the foam can be substantially abrasive. While the foam itself can be abrasive, abrasive grit or similar materials can be laminated to at least portions of the foam body which contact the nail areas of a user, this abrasive capability being best utilized for removal of nail coatings such as acrylic artificial nails or artificial nails formed of other materials such as can be softened and/or dissolved by means of solvents such as acetone and the like. Prior methodology for removing such artificial flails involves the prolonged soaking of the fingers including the nail areas in a solvent such as acetone, the fingers thus being exposed to prolonged contact with the liquid solvent. Further, solvent vapors issuing from such a soaking bath are unavoidably inhaled by a user and further by individuals in proximity to the user. This time-consuming and labor-intensive task, whether accomplished by a professional manicurist or by an individual caring for her own nails, is markedly expedited through use of the present invention. The methodology of the invention is of particular significance in this situation since a continual and repeated reversing of the cartridge-bearing container facilitates removal of artificial nails and similar coatings. When a portion of a foam body is formed to be aggressively abrasive such as for removal of acrylic artificial nails and the like, then the motor driving the container can be reversed repeatedly within the same revolution such that the abrasive portion of the foam body contacts only the nail surfaces and does not contact the surfaces of the finger opposite the nails, thereby producing less wear on the skin of the fingers.

The single-use cartridge of the invention can be filled with materials in addition to the coating-removing solvent, materials such as cuticle conditioner, nail conditioner, nail buffer, etc. being packaged within these cartridges to provide treatment of the nails and even of the skin of the fingers while nail coatings are being removed according to a practice of the invention. The methodology and apparatus of the invention are especially useful to the professional manicurist but are also of benefit to any user. The professional manicurist saves valuable professional time and reduces exposure to solvents through use of the invention thereby increasing income through the ability to devote more time to those tasks requiring skill. The professional manicurist and those working in the environment of a beauty salon also enjoy reduced exposure to solvent fumes when the manicurist utilizes the methodology and apparatus of the invention.

It is therefore an object of the present invention to provide method and apparatus for removing coatings from the fingernails whereby a single-use cartridge containing a flexible foam body saturated with a coating-removing solvent is rotated in contact with a fingernail to remove a coating on said nail.

It is another object of the invention to provide method and apparatus for removal of nail coatings from the fingernails whereby a solvent-saturated foam body is rotated in both clockwise and counter-clockwise rotation while in contact with a coated fingernail, the change of rotation being either within a single revolution or after a number of revolutions in each direction to facilitate removal of a coating from the nail.

A further object of the invention is to provide method and apparatus useful particularly by a professional manicurist which facilitates removal of nail coatings from the nails of a client while providing a more healthful environment for the manicurist, client and other individuals in proximity thereto.

Further objects and advantages of the invention will become more readily apparent in light of the following detailed description of the preferred embodiments.

DESCRIPTION OF THE PREFERRED EMBODIMENTS

Figure 1:
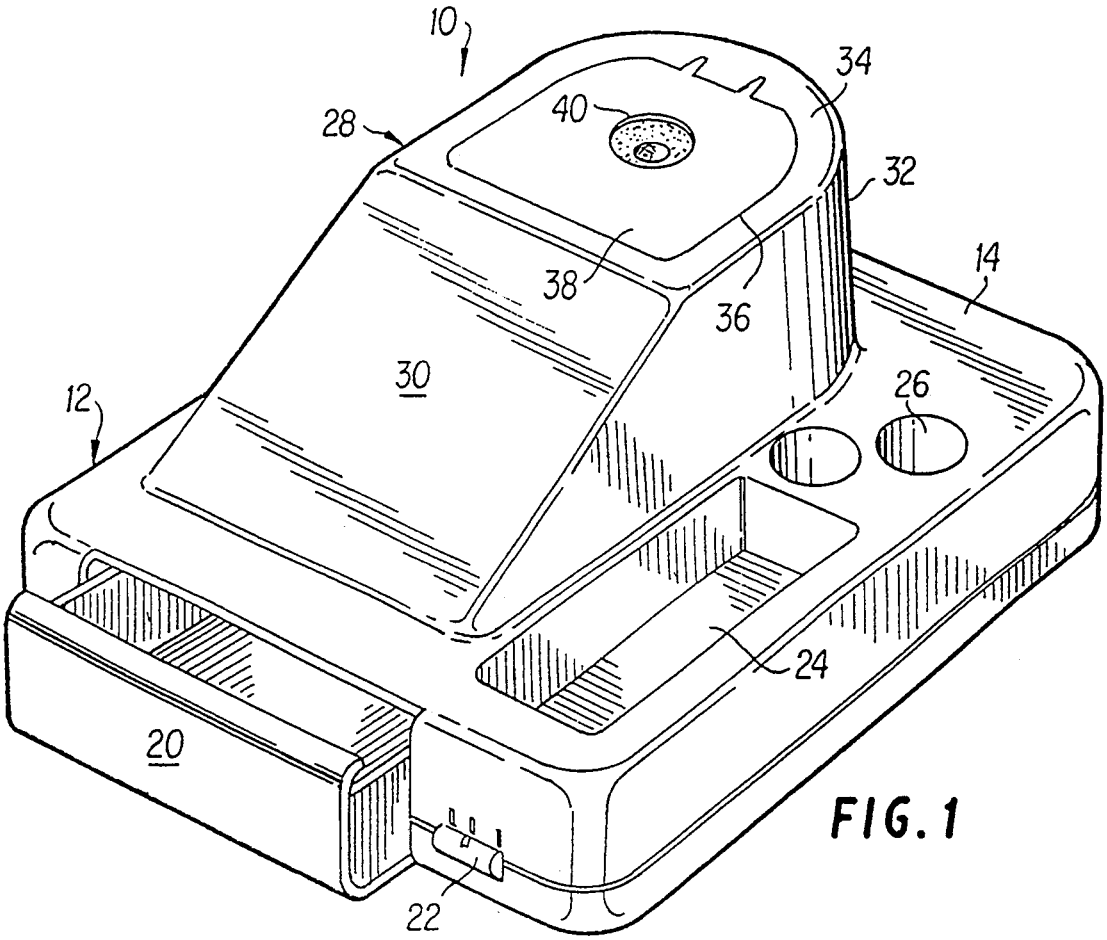
FIG. 1 is a perspective view of an apparatus suitable for table-top use, the structure seen in the drawing housing the nail coating removal structure of the invention and further housing manicuring articles ancillary to use of the invention.

Referring now to the drawings and particularly to FIG. 1, an apparatus configured according to the present invention is shown generally at 10 to include a housing 12 which is particularly suited for use in the environment of a beauty salon. The housing 12 comprises an upper base 14 and a lower base 16 (best seen in FIG. 2), the lower base having pad mounts 18 preferably formed of rubber or other elastomeric material so that vibration is reduced on operation of the apparatus 10. The upper base 14 is seen to include a drawer 20 which is capable of holding articles useful in the manicuring process. A switch 22 is disposed on a forward face of the upper base 14 and includes an off setting as well as "forward" and "reverse" settings such that rotation of structure yet to be described can be manually changed from clockwise to counter-clockwise rotation and back as desired and as will be discussed in greater detail hereinafter. The housing 12 can further be provided with formed depressions such as the tray 24 and cylindrical apertures 26 which are suited to receive articles useful in the manicuring process.

Figure 3:
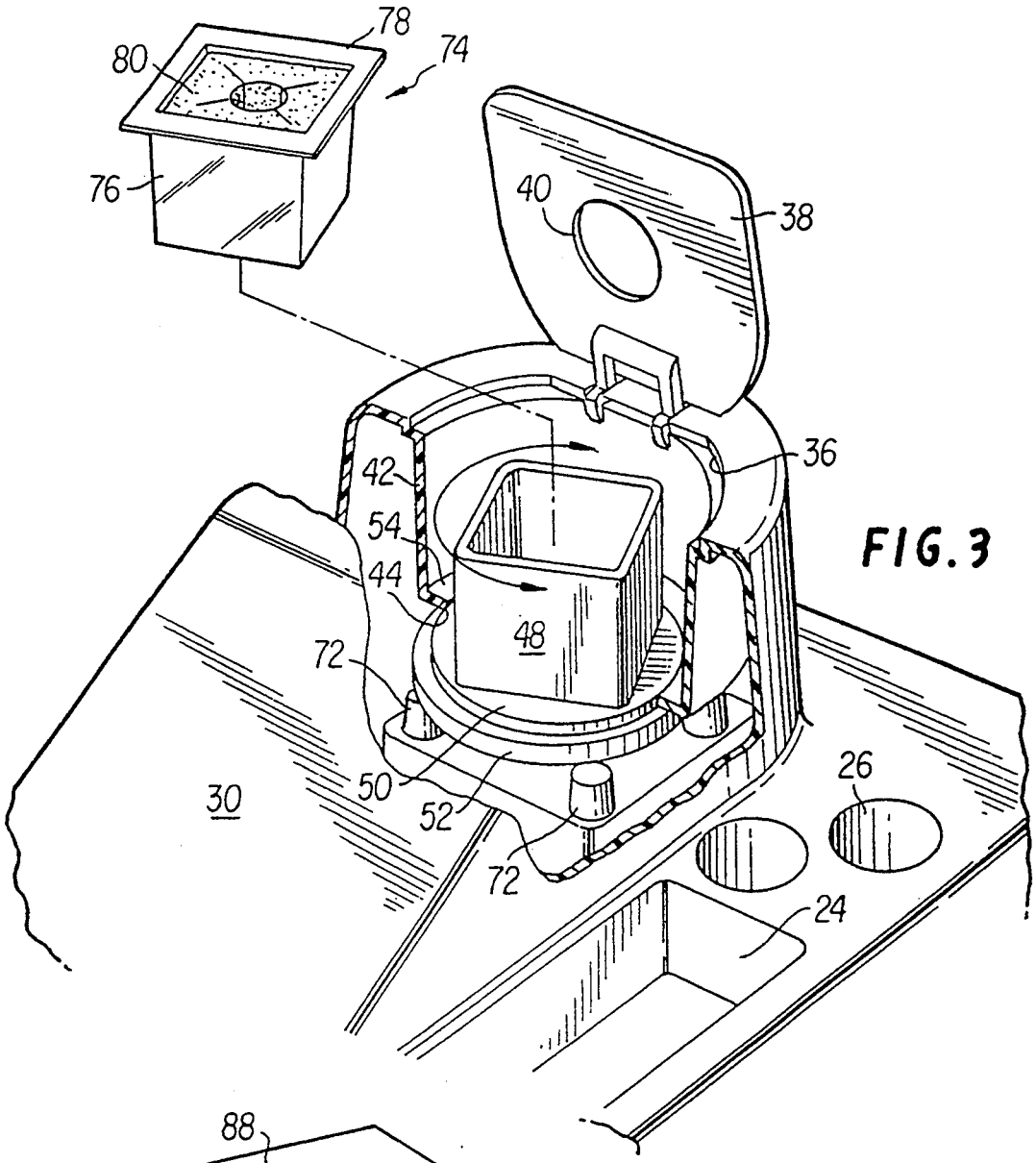
FIG. 3 is a perspective of a reduced portion of the apparatus of FIG. 1 and which is partially cut away to illustrate particular portions of the apparatus, the figure also comprising an assembly view illustrating use of the apparatus.

A support housing 28 rises from an upper surface of the upper base 14 and is preferably formed integrally with the upper base 14. The support housing 28 includes a slanted support surface 30 and an arcuate rear housing portion 32, the rear housing portion 32 having an upper horizontal surface 34 formed with an opening 36 which is best seen in FIG. 3. A hinged cover plate 38 is mounted to close the opening 36, the plate 38 having an aperture 40 disposed centrally therein which allows a user of the apparatus 10 to extend at least the distal end of a finger into said aperture 40 for treatment by structure yet to be described.

Figure 2:
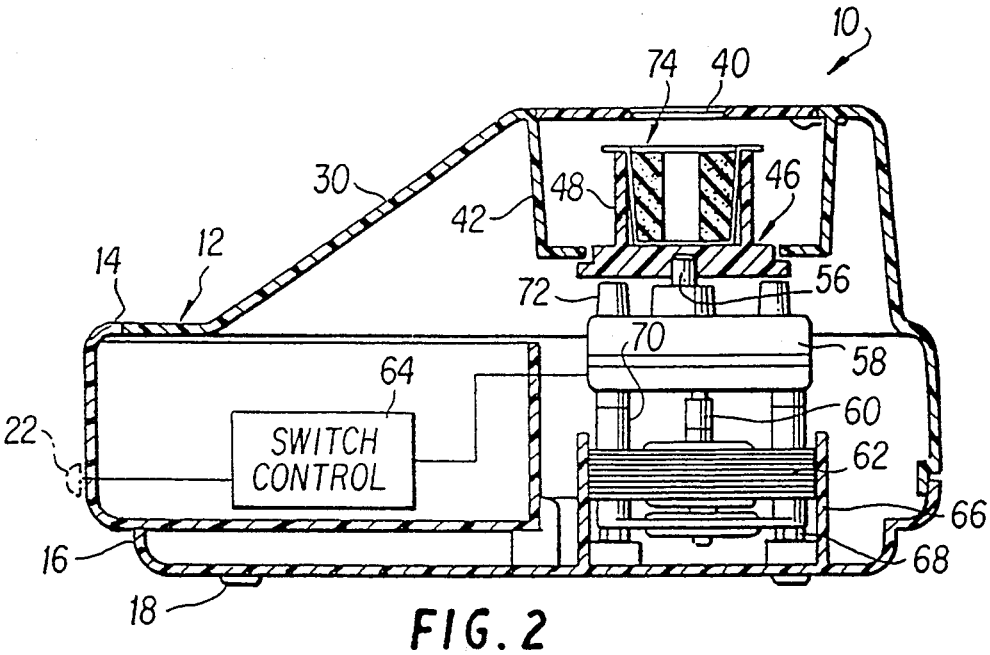
FIG. 2 is an elevational view in partial section of the apparatus of FIG. 1 and including a simplified circuit diagram.

As can be appreciated from the illustration of FIG. 1 as well as FIGS. 2 and 3, upper portions of the housing 12 can be formed substantially as a single molded unit with lower portions of the housing 12, such as the lower base 16, being removably attached to the upper base 14, for example, by means of screws (not shown) or other fasteners in order that structure yet to be described can be mounted within the interior of the housing 12 and serviced as desired. As will be appreciated by those of skill of the art, structural features such as the drawer 20, tray 24, etc. need not be provided but are useful within the environment of use of the apparatus 10.

Referring now not only to FIG. 1 but also to FIGS. 2 and 3, an inner housing cup 42 is shown to be formed about the opening 36 in the rear housing portion 32, the housing cup 42 having an aperture 44 formed in the bottom thereof which receives a pedestal plate 46 for rotation within said aperture 44. The pedestal plate 46 mounts either removably or integrally a container 48 which is open at its uppermost end. The container 48 can be rotated in either direction depending on rotation of the pedestal plate 46 as will be described hereinafter. The container 48 can take the shape of a cylinder or other geometrical figure. However, it is preferred to form the container 48 as a hollow rectangular solid. For the sake of appearance, and for ease of using thermally formed plastic cartridges as will be described hereinafter, the container 48 is provided with rounded corners which provide a softer appearance. The container 48 is centered on the pedestal plate 46 such that the aperture 40 in the cover plate 38 is centered above the open end of the container 48 when the cover plate is closed over the opening 36.

The pedestal plate 46 can be provided with upper and lower base elements 50 and 52, the diameter of the upper base element 50 being reduced relative to the diameter of the lower base element 52 such that a track is provided to allow receipt of a flange 54 which defines the aperture 44 formed in the housing cup 42. The pedestal plate 46 thereby rotates with the upper base element 50 being received within the aperture 44 so that said plate 46 is maintained in a desired location.

The pedestal plate 46 is attached to a drive shaft 56 driven through a control unit 58 which is in turn driven through shaft 60 by motor 62, the motor 62 being electrically driven. It should be noted that the drive shaft 56 could be otherwise driven, such as by gear arrangements, belting, etc. However, it is preferred to drive the shaft 56 through a control unit such as the unit 58 which can contain gear reduction devices, rotational control apparatus, eccentric drive mechanisms, etc. such as are conventional in the art arid which are not illustrated for the sake of convenience. The switch 22 acts through switch control element 64 to both provide power to the motor 62 and to allow control of the control unit 58 such that the rotational sense of the container 48 can be controlled as desired and as will be discussed in more detail hereinafter.

The motor 62 is mounted within housing 66 which extends from inner surfaces of the lower base 16, the motor 62 being mounted such as by conventional fasteners 68 to maintain the motor 62 in a desired position. The motor can take the form of an automatically reversible unit such as is manufactured by Hurst Manufacturing Company, a division of Emerson Electric Company, Princeton, Ind. This motor automatically reverses when stopped either after a partial revolution or one or more full revolutions. Similarly useful motors are available in the art and need not be described in detail herein. The motor 62 drives the shaft 60 which transmits rotation through the control unit 58 to the drive shaft 56. As will be appreciated from a review of FIG. 2, the shafts 56 and 60 are not aligned so that eccentric mechanisms (not shown) located within the control unit 58 can cause rotation of the container 48 only during a portion of each revolution of said shafts 56 and 60. However, the control unit 58 can be configured such that an essentially direct drive, or a reduced gearing drive, can rotate the container 48 through the drive shaft 56 through full revolutions. Further, the control unit 58 is configured to be controlled by the switch control 64 to change the angular sense of the drive shaft 56 and thus the container 48 as is desired in practicing the methodology of the invention.

The control unit 58 can be seen particularly in FIG. 2 to be supported in spaced relation to the motor 62 by means of support posts 70. Leveling posts 72 are also seen in FIGS. 2 and 3 to be provided below the pedestal plate 46 to prevent undesired canting of the pedestal plate 46.

Figure 4:
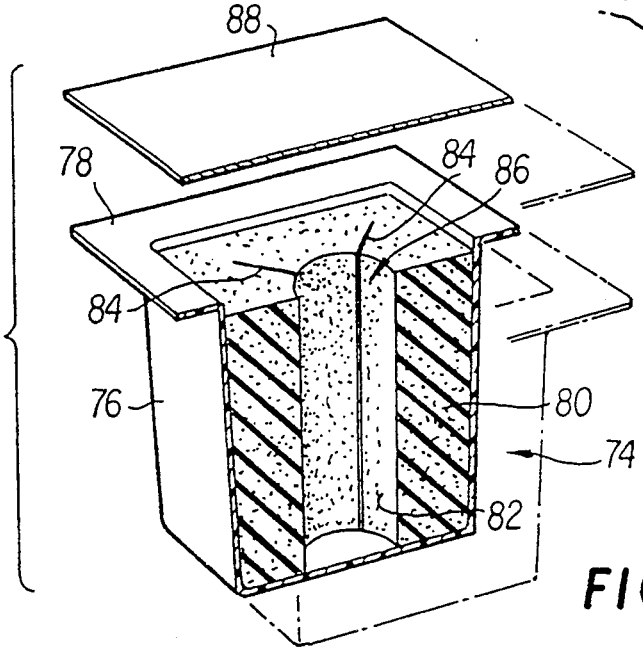
FIG. 4 is a perspective view in section of a single-use cartridge usable with the apparatus of FIGS. 1 through 3; and, FIG. 5 is a perspective view of an alternative embodiment of a sealing foil used to cover the structure of FIG. 4.

Referring now to FIGS. 2, 3 and 4, a single-use cartridge 74 is seen to be insertable into the container 48 for rotation with said container 48 when the apparatus 10 is in use. The cartridge 74 essentially comprises a thermally formed plastic material or material otherwise produced and includes a cup portion 76 open at one end and surmounted at the open end by means of a flange 78. The cup portion 76 of the cartridge 74 receives a foam body 80 which is saturated with a solvent for a nail coating, the solvent typically being acetone or certain acetate compounds. The foam body 80 fits snuggly within the cup portion 76 such that said foam body 80 positively moves with the cartridge 74 and does not slip within cartridge 74. While the foam body 80 and the cup portion 76 can be formed in a substantially cylindrical manner, the potential exists with cylindrical shapes for "free wheeling" such that the foam body 80 does not positively move with the cartridge 74. Similarly, the cartridge 74 with its essentially square cross section fits closely within the interior of the container 48 such that slippage between said container 48 and said cartridge 74 does not occur.

The foam body 80 can be provided with a central bore 82 having slits 84 formed regularly thereabout, the bores 82 receiving the distal end of a finger, and particularly the nail portion of the finger, therewithin such that a nail coating contacts walls of the bore 82 substantially over all surfaces of the nail such that the nail coating is brought into intimate contact not only with the relatively abrasive foam walls of the bore 82 but also with the solvent saturating the foam body 80. The slits 84 allow a more regular expansion of the bore 82 on insertion of a relatively larger finger, the slits 84 allowing the bore 82 to more easily conform to various finger dimensions. It should be appreciated here that the foam body 80 can be simply formed with slits such as the slits 84 located centrally therein without the need for a formed bore. The use of a single slit or a single slot as well as intersecting slits or slots will allow a finger to be received into the foam body 80 in a suitable manner.

As best seen in FIG. 4, a given surface portion of the bore 82 such as is represented by that portion 86 between the illustrated portions of the slits 84 can be provided with a more aggressively abrasive material such as grit bonded to the portion 86 of the foam body 80. Through controlled rotation of the container 48 and thus of the cartridge 74, the more abrasive surface portion 86 can be rotated only in contact with a nail coating on the finger of a user, such coating comprising an artificial fingernail or the like, in order to more efficiently remove the artificial fingernail without substantial contact between the skin on the distal end of the finger and the more abrasive surface portion 86. Alternatively, the foam body 80 itself can be formed of various foam materials of varying relative abrasiveness depending upon the nature of the nail coating which is to be removed.

Figure 5:
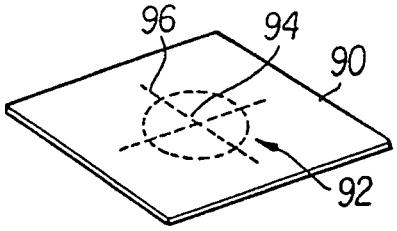

As is best seen in FIG. 4, a foil sheet 88 is formed over the open end of the cartridge 74 and is sealed in place through contact with upper surfaces of the flange 78. In use, the entire foil sheet 88 can be removed from the cartridge 74 either prior to or after insertion of the cartridge 74 into the container 48. In this manner, the solvent contained within the cartridge 74 and saturating the foam body 80 is not permitted to evaporate. The structure of FIG. 5 can be utilized to minimize evaporation of a solvent saturating the foam body 80 even during use of the apparatus 10. In particular, foil sheet 90 is seen to be provided with a weakened portion 92 which can conveniently be shaped as a circle and which can have two or more weakened diameters 94. Through use of the foil sheet 90, the cartridge can be inserted into the container 48 and not "opened" until a user is ready to insert a finger through the weakened portion 92 of the foil sheet 90. The weakened diameters 94 can have weakened portions 96 extending beyond the weakened circle such that fingers of varying size can cause a substantially controlled tearing along the diameters 94 to accommodate various finger dimensions. Use of the foil sheet 90 results in only a portion of the solvent-saturated foam body 80 being open to the atmosphere, thereby reducing the quantity of solvent which evaporates into the atmosphere.

Referring again to FIG. 3, it is seen that the hinged cover plate 38 can be opened to facilitate insertion or removal of one of the cartridges 74 into the container 48. The cover plate 38 is then closed, the aperture 40 allowing access by the finger of a user into the interior of the foam body 80. The bore 82 of the foam body 80 is located within said foam body 80 such that it is substantially aligned with the center of the aperture 40. The hand of a user is conveniently rested on the slanted support surface 30 such that each finger can be separately and sequentially inserted through the aperture 40 in the plate 38 and into the bore 82 of the foam body 80. Solvent and surface portions of the bore 82 intimately contact a nail coating substantially over the full surface thereof when the distal end of a finger is inserted thereinto. Operation of the switch 22 then causes a desired rotation of the container 48 and thus rotation of the foam body 80, a nail coating thus being very rapidly removed from the nail of the inserted finger. Rotation of the container 48 can be controlled manually through the switch 22 or controlled automatically according to a "program" of rotation devised for particular settings of the switch 22. The direction of rotation of the container 48 can be initially either clockwise or counterclockwise and can proceed through one or more full revolutions in any given directional sense or through only a partial revolution as is desired for a particular coating removal situation. Reversal of the original angular direction can then proceed for one or more full revolutions or even a partial revolution only before again reversing direction. Change of angular direction can occur with any desired rapidity, the change of direction acting to more completely remove coatings from the fingernail especially in traditionally difficult areas such as the nail cuticle.

Use of the apparatus 10 by a professional manicurist is particularly advantageous since the cartridge 74 can be changed after use of the apparatus 10 by successive clients. In essence, each client would use one of the cartridges 74 with that cartridge then being discarded after use. The client is thus assured sanitary conditions and the manicurist readily complies with health restrictions which do not allow use of a dip polish remover by more than one individual within the environment of a beauty salon. In addition, different cartridges 74 can include different materials intended for different applications. One of the cartridges 74 can be provided with emollient compositions either with or without nail coating removal solvents such that the nails and skin of the fingers can be conditioned either separately or simultaneously with removal of nail coatings. Further, certain of the cartridges 74 can be provided with more abrasive materials utilized as one of the foam bodies 80 or with foam materials having abrasive surfaces to facilitate removal of more difficulty removed nail coatings.

Accordingly, the present methods and apparatus of the invention provide substantial advantage over the methodology and apparatus of the prior art and especially within the use environment of a professional manicurist. While the invention has been described in light of particular embodiments thereof, it is to be appreciated that the invention can be practiced other than as explicitly shown and described herein, the scope of the invention being defined by the appended claims.

What is claimed is:

1. In an apparatus for removal of a coating from the nail of a user, the apparatus including at least one container having a nail-contacting material disposed therein and a solvent for said coating associated with said material, a finger of a user being inserted into the container to contact the material and the solvent, the improvement comprising:

abrasive means disposed over only certain portions of those nail-contacting material surfaces which function to contact the nail, said abrasive means being more abrasive to the coating than is the nail-contacting material.

2. In the apparatus of claim 1 wherein the nail-contacting material comprises a foam body having a receiving aperture formed therein to receive at least the distal end of said finger of said user, the solvent being present in the foam body and the receiving aperture having wall surfaces which contact the nail, the abrasive means being disposed over said portions of said wall surfaces.

3. In the apparatus of claim 1 and further comprising control means coupled to the container for rotating the container and for changing the direction of rotation of the container.

4. In the apparatus of claim 1 wherein the improvement further comprises means coupled to the container for rotating the container through at least a partial revolution and for changing the direction of rotation of the container at least twice during a single revolution.

5. In an apparatus for removal of a coating from the nails of a user, the apparatus including at least one container element having a recess formed therein and mounted for rotation by means of a powered drive train, and further including a nail-contacting material and a solvent for a given nail coating associated with said material, the material and the solvent acting to remove the coating from the nail of a user, the nail-contacting material comprising a foam body having a receiving aperture formed therein to receive at least the distal end of said user's finger, the solvent being present in said foam body, the improvement comprising:

a cartridge adapted to be carried within the recess of the container element and having the nail-contacting material and solvent contained within said cartridge, a finger of a user being inserted into the cartridge to contact the material and the solvent, the cartridge being removable from the container element after use by one user to dispose of the nail-contacting material and solvent contaminated by residue of the coating on removal from the user's nail and to prevent contact between said residue, used material and used solvent and a subsequent user of the apparatus, wall surfaces of the aperture in the foam body having an abrasive material disposed over at least portions of said wall surfaces, the cartridge being rotatable with the container element.

6. In the apparatus of claim 5 wherein the abrasive material is disposed over less than full surface areas of the receiving aperture.

7. In the apparatus of claim 5 and further comprising control means for rotating the container element and for changing the direction of rotation of the container element.

8. In the apparatus of claim 5 wherein the improvement further comprises means coupled to the container element for rotating the container element through at least a partial revolution and for changing the direction of rotation of the container element at least twice during a single revolution.

9. In the apparatus of claim 5 wherein the recess of the container element into which the cartridge is received is non-circular in section, the cartridge and the recess being congruently shaped, and wherein the cartridge and the foam body are congruently shaped with the foam body occupying essentially the entire volume of the cartridge.

* * * * *